US005160968A

United States Patent [19]

Yamada et al.

[11] Patent Number: 5,160,968

[45] Date of Patent: Nov. 3, 1992

[54] DEVELOPING MEANS AND METHOD FOR SUPPLYING TONER TO A DENSITY DETECTION POSITION AND AT LEAST ONE OTHER POSITION

[75] Inventors: Motohiro Yamada; Mineo Yamamoto, both of Okazaki; Koji Shakushi, Toyohashi, all of Japan

[73] Assignee: Minolta Camera Kabushiki Kaisha, Osaka, Japan

[21] Appl. No.: 828,117

[22] Filed: Jan. 30, 1992

[30] Foreign Application Priority Data

Jan. 31, 1991 [JP] Japan ..... 3-11172

[51] Int. Cl.[5] ..... G03G 21/00

[52] U.S. Cl. ..... 355/208; 355/246

[58] Field of Search ..... 355/203, 204, 208, 214, 355/245, 246, 260; 118/653, 656, 688-690

[56] References Cited

U.S. PATENT DOCUMENTS

| | | | |
|---|---|---|---|
| 4,942,431 | 7/1990 | Tada | 355/246 |
| 4,967,691 | 11/1990 | Chikama et al. | 118/656 |
| 4,985,823 | 1/1991 | Tada et al. | 355/246 X |
| 5,005,517 | 4/1991 | Fukui et al. | 118/689 |
| 5,006,893 | 4/1991 | Yokoyama | 355/208 |
| 5,040,023 | 8/1991 | Yokoyama | 355/208 |
| 5,049,938 | 9/1991 | Ueda | 355/246 |

FOREIGN PATENT DOCUMENTS

| | | |
|---|---|---|
| 54-27439 | 3/1979 | Japan . |
| 62-28780 | 2/1987 | Japan . |

*Primary Examiner*—A. T. Grimley
*Assistant Examiner*—William J. Royer
*Attorney, Agent, or Firm*—Burns, Doane, Swecker & Mathis

[57] ABSTRACT

An image forming apparatus having a developing device wherein a developing material of a toner and a magnetic carrier is circularly transported from a toner supply portion to a developing region formed between the developing device and a photosensitive member while mixing the developing material. The developing device is provided with a sensor for detecting a toner density of the circulating developing material at a specified detection position in the developing device, and the toner is supplied from the supply portion to the developing material at the specified detection position and to the developing material at a minimum of one position other than the detection position when the detected toner density of the developing material is less than a predetermined standard density.

10 Claims, 12 Drawing Sheets

DEVELOPING MEANS AND METHOD FOR SUPPLYING TONER TO A DENSITY DETECTION POSITION AND AT LEAST ONE OTHER POSITION

BACKGROUND OF THE INVENTION

1. Field of the Invention

The present invention relates to an image forming apparatus for copying machines, printers facsimile machines and the like having a developing device that uses a two-component developing material containing both a toner and a carrier.

2. Description of the Related Arts

FIGS. 1 and 2 show a developing device 1 used in conventional copying machines.

The developing device 1 has a developing roller 3 provided in the developing portion 2 opposite the copying machine type photosensitive member 100. The developing roller 3 comprises an internal magnet roller 4 and external sleeve 5, wherein said magnet roller 4 is stationary in a non-rotatable state and said sleeve 5 is rotatable in the direction indicated by arrow a via a motor 6.

Developing material transport paths 9 and 10 are respectively provided at the front and back of the circulation transport portion 7 disposed at the back of the developing portion 2 and are further separated by a partition wall 8. One end of the back transport path 10 is extended to form the toner supply portion 11 (left side in FIG. 2). The transport paths 9 and 10 are connected via openings 12 and 13 formed in the partition wall 8 provided opposite both ends of the front transport path 9. Further, the transport paths 9 and 10 are respectively provided with spirals 14 and 15, which are rotatable in the directions of the arrows b and c, respectively, via the actuation of the motor 16. The back transport path 10 is also provided with a toner density sensor 17, the detection data output from which are transmitted to the microcomputer MC.

A toner supply path 22 is provided at the bottom of the toner hopper 21 in the toner supply device 20. A bottom opening 23 provided at one end of the toner supply path 22, so as to be positioned above the supply path 11 of the aforesaid back transport path 10. A supply spiral 24 is further disposed in the toner supply path 22, so as to be rotatable via the actuation of the toner supply motor 25.

The previously described developing device 1 accommodates in the front and back transport paths 9 and 10 a two-component magnetic developing material containing toner and carrier. The developing material is circulated in the counterclockwise direction in FIG. 2 in transport paths 9 and 10 via the rotation of the front and back spirals 14 and 15. That is, in FIG. 2, the developing material in the front transport path 9 is transported from the right side to the left side, so as to enter the back transport path 10 via a communicating path 13. On the other hand, the developing material in the back transport path 10 is transported from the left side to the right side, so as to enter the front transport path 9 via a communicating path 12. Furthermore, the developing material transported through the front transport path 9 is maintained on the exterior surface of the developing roller 4, so as to be delivered opposite the photosensitive member via the rotation of the sleeve 5, and thereby develop via the delivered toner the electrostatic latent image formed on the surface of the photosensitive member 100. The developing material that has expended toner in the region opposite the photosensitive member is again returned to the front transport path 9 via the rotation of the aforesaid sleeve 5. Accordingly, the toner density during the period the developing material is transported from the right side to the left side of the transport path 9 in the drawing is reduced, i.e., the ratio by weight of the toner to the carrier is reduced.

The reduced toner density is compensated by controlling toner supply as described below. The toner density sensor 17 detects the toner density of the developing material passing the region P3 (hereinafter referred to as "detection position P3") opposite said sensor 17 at predetermined intervals, and the detection data is transmitted from the sensor 17 to the microcomputer MC. In the microcomputer MC, the measured toner density is compared to a standard reference toner density for the purpose of controlling toner density. If the toner density is reduced below a predetermined reference density, the toner supply motor 25 is actuated with a specific timing so as to precisely supply toner in the developing material determined to have a low toner density by the aforesaid toner density sensor 17, and a predetermined quantity of toner is supplied through the supply path 11 via the rotation of the supply spiral 24. The supplied toner is transported from the left side to the right side in FIG. 2 via the rotation of the back spiral 15, so as to supply the toner in the aforesaid developing material determined to have a low toner density at a converging position P0 wherein the supplied toner joins the developing material.

The previously described developing device 1, however, has a disadvantage inasmuch as suitable toner density cannot be assured even when toner is supplied at the converging position P0 in an amount which corresponds to the amount of toner density reduction, because toner is consumed during the: process of transporting the developing material through the front transporting path 9 after the developing material toner density has been detected at the detection position P3.

When the previously described developing device 2 was used to continuously form images and the image densities of the produced images were measured, wide variations were confirmed between the image density (ID) and output voltage of the tone density detecting sensor 17, as shown in FIGS. 3 and 4. The solid line, broken line and chain line in FIG. 3 respectively correspond to the regions at the right side, center and left side of the developing device shown in FIG. 2.

That is, the developing device having circulating developing material as previously described provides toner supply control that is incapable of producing adequate density stability only by simply supplying toner in the portion of the developing material having reduced toner density.

SUMMARY OF THE INVENTION

A main object of the present invention is to provide an image forming apparatus capable of maintaining constant uniform toner density of the developing material within the two-component developing device.

A further object of the present invention is to provide an image forming apparatus capable of uniformly supplying the toner in the developing material circulating within the two-component developing device.

These objects of the present invention are accomplished by providing an image forming apparatus having developing device having a developing means for transporting developing material comprising a toner and a magnetic carrier toward a developing region, and a transport means for mixing and circulating the developing material from the toner supply portion toward the developing means, and from the developing means toward the toner supply portion;

supply means for supplying toner from the toner supply portion into the developing device;

detecting means provided in the developing device for detecting toner density of the circulating developing material at a detection position in the developing device; and control means for controlling the supply means so as to supply the toner to the developing material at the detection position in the developing device and at a minimum of one position other than the detection position when the detected toner density is less than a predetermined density.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
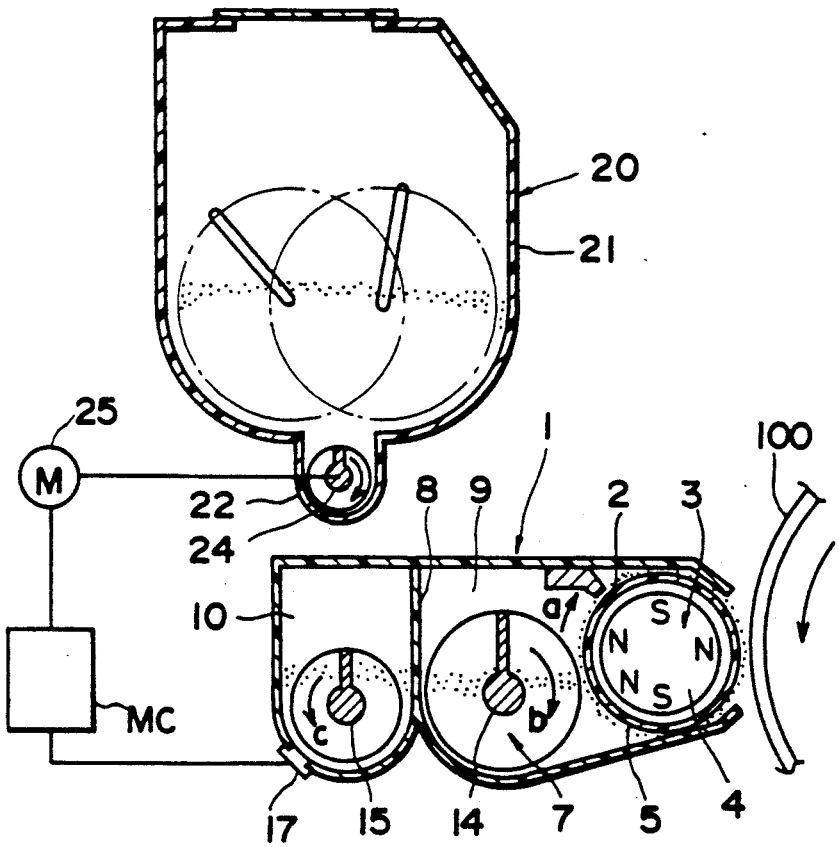
FIG.1 PRIOR ART
FIG. 1 is a vertical section view showing the toner supplying device and developing device of a conventional copying machine.
Figure 2:
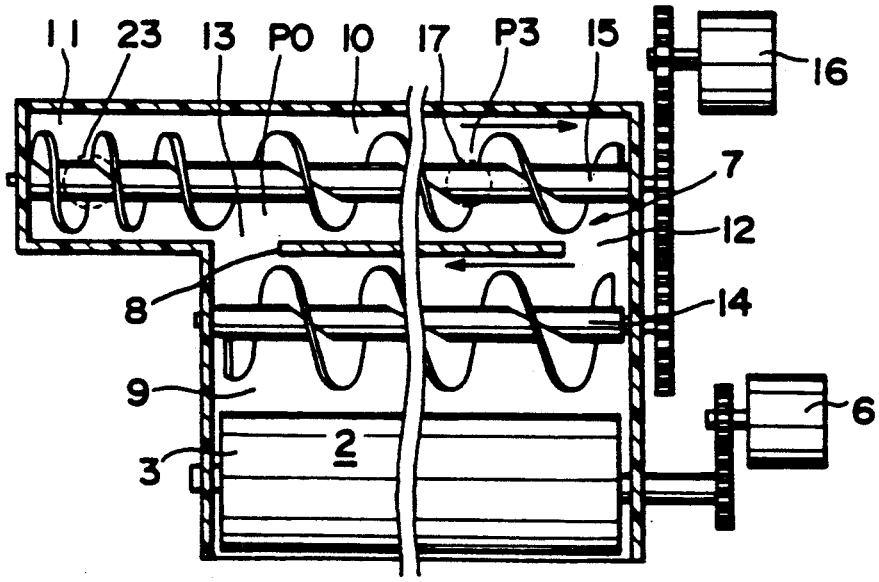
FIG.2 PRIOR ART
FIG. 2 is a horizontal section view showing the developing device of a conventional copying machine.
Figure 3:
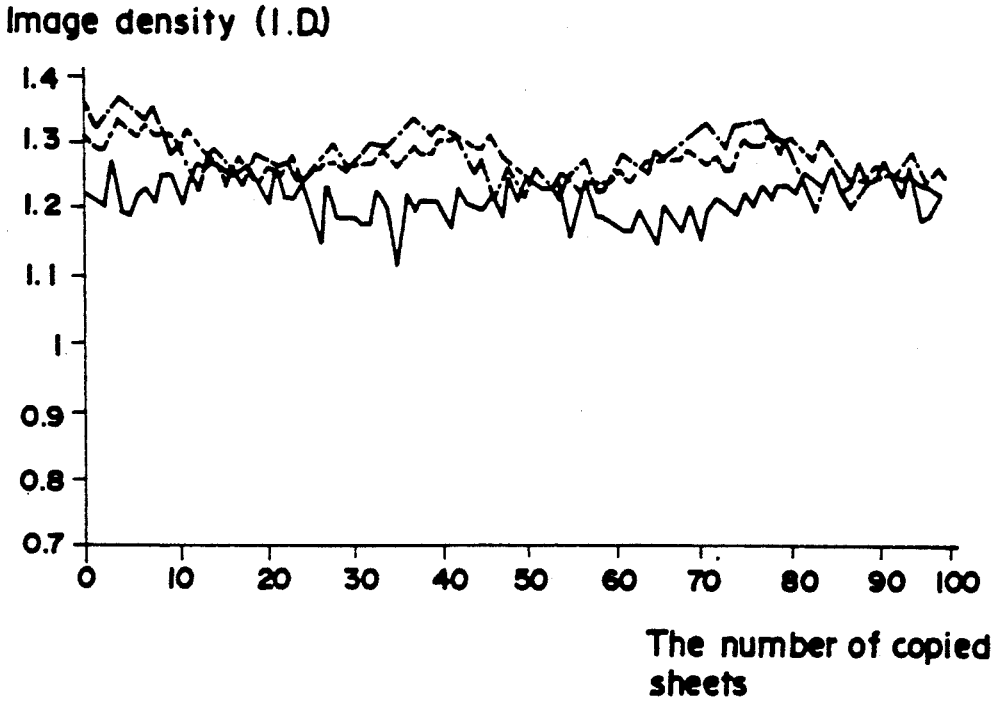
FIG.3 PRIOR ART
FIG. 3 is an illustration showing the relationship between the number of copied sheets and image density in copying machines using conventional toner supplying methods.
Figure 4:
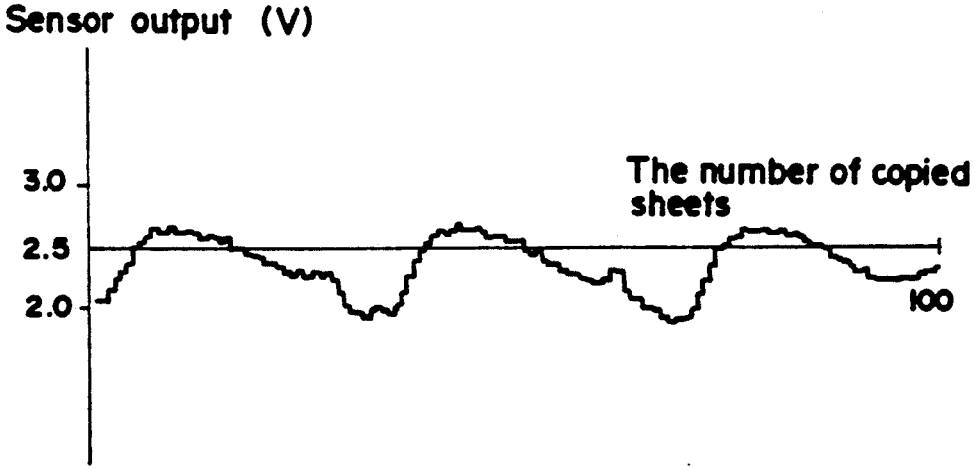
FIG.4 PRIOR ART
FIG. 4 is an illustration showing the relationship between the number of copied sheets and sensor output in copying machines using conventional toner supplying methods.
Figure 5:
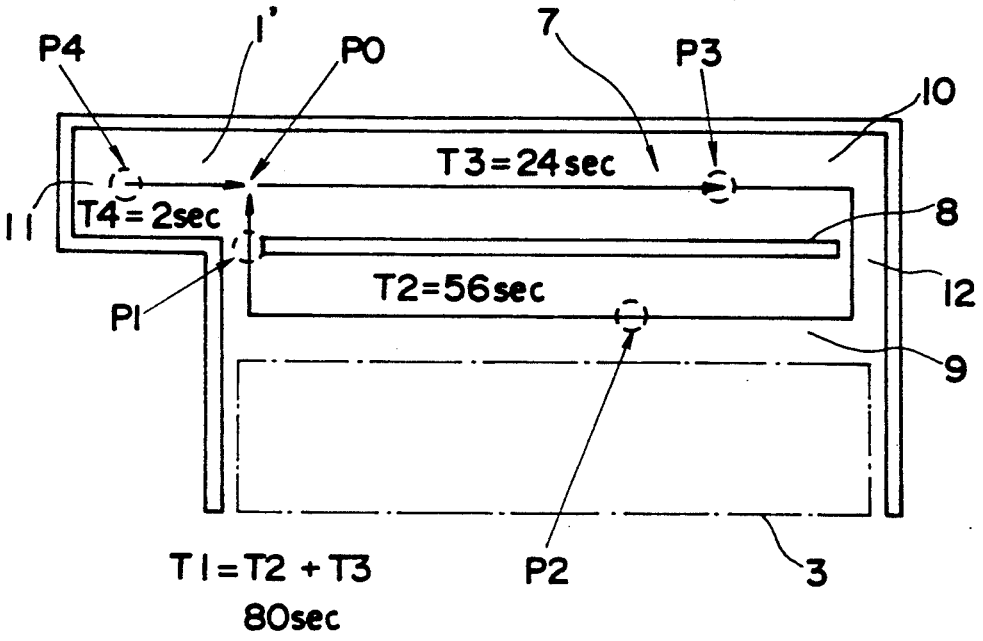
FIG. 5 is a top plan view showing the circulating transport path of the developing material within the developing device provided in a first embodiment of the copying machine of the present invention.
Figure 6:
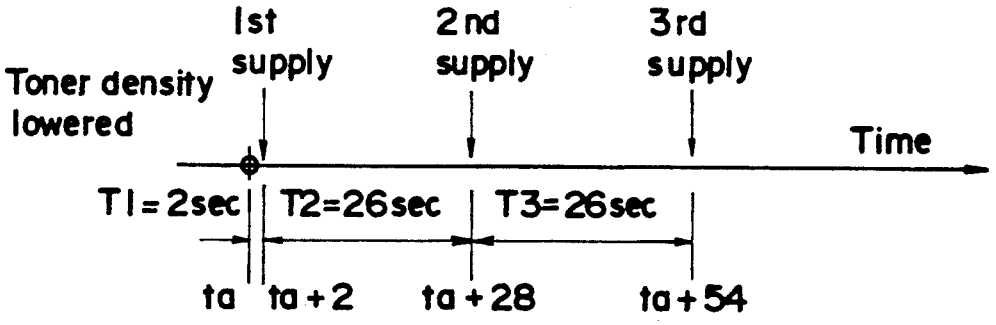
FIG. 6 is an illustration showing the timing for supplying toner in the developing material transported through the transport path shown in FIG. 5.

FIG. 5 shows the developing material circulation path of the developing device 1' provided in the first embodiment of the copying machine of the present invention. The developing device 1' has a construction identical to that of the previously described developing device 1. Accordingly, like parts of said developing devices 1 and 1' are designated by like reference numbers, and the spiral members and the like are omitted.

In the developing device 1', the time T1 required for the developing material to make a single circuit of the transport paths 9 and 10 is set at 80 seconds by setting various conditions. The detection position P3 of the toner density sensor 17 is positioned so that the developing material that has passed the aforesaid detection position P3 reaches the converging position P0 at a time T2 of 56 seconds. Accordingly, the time T3 required for the developing material that has passed the converging point P0 to reach the detection position P3 is 24 seconds. The toner supply position P4 is positioned so that the supplied toner reaches the converging position P0 at a time T4 of 2 seconds.

In the previously described construction, the toner density sensor 17 detects the toner density of the developing material in predetermined time intervals of, for example, 2 seconds. When the toner density detected at a specific moment ta is determined to be less than a predetermined reference density, the toner is supplied in three times in relation to the aforesaid determination.

More specifically, when a determination is made via the microcomputer MC that the toner density is low at a moment ta, the toner supply motor 25 is actuated 2 seconds after said moment ta, and the first toner supply is accomplished. Then, the toner supply motor 25 is again actuated 28 seconds after the aforesaid moment ta to accomplish the second toner supply. The toner supply motor 25 is actuated again 54 seconds after the aforesaid moment ta to accomplish the third toner supply.

The toner introduced at the supply position reachs the converging position after a timer T4 (=2 s) from the respective moments of supply (ta+2 s, ta+28 s, ta+54 s), i.e., at the respective moments (ta+4 s, ta+30 s, ta+56 s). The toner for first supply is deliverd at position P1 on the upstream side of the converging position P0 with respect to a developing material transport direction at the moment ta, and is supplied to the developing material moving to the converging position P0 four seconds after the moment ta. The toner for second supply is delivered at the intermediate position P2 at the moment ta, and is supplied to the developing material moving to the converging position P0 30 seconds after the moment ta. The intermediate position P2 is disposed intermediately between the detection position P3 and the converging position P0 in the direction of transport of the developing material. The toner for third supply is delivered at the detection position P3 at the moment ta, and is supplied to the developing material moving to the converging position P0 56 seconds after the moment ta.

Thus, when it is determined that the developing material toner density is less than the reference density at a particular moment ta, the toner is supplied to the developing material at the detection position P3 at the moment ta, and to the developing material at positions P1 and P2 thereby dividing the circulation path into three parts using the detection position P3 as a reference position.

Conventional toner supply methods supply toner in quantities necessary to return the toner density to the reference density value when the toner density is determined to be lower than said reference density. The toner supply method of the present invention, however, provides a plurality of toner supplies for a single toner supply signal. If the quantity of toner supplied by conventional methods is designated M, and the quantity of toner for a single supply via the method of the present invention is designated m, and is preferably set at (1/number of partitions)·M.

Before providing a detailed description of the toner supply control, the toner supply data DTCLSP created in the toner supply control are defined.

The toner supply data DTCLSP are created to determine whether or not to supply toner to specific regions (specific parts) of the developing material circulating in the transport path, and set the reference criteria for determining the quantity of toner to be supplied. The toner supply data DTCLSP are further created to divide a single circuit of the developing material circulation path into multiple parts and are produced relative to the developing material at each of said respective parts based on toner density sensor detection results.

More specifically, the developing material circulating path is divided into 40 parts moving counterclockwise from the converging position P0 which is the reference position, and toner supply data DTCLSP (02), . . . , (80) for each part of the developing material transported to the converging position P0 after 2 seconds, 4 seconds, . . . , 80 seconds are respectively stored in the memory of the microcomputer MC at addresses M(02), . . . , (78), and (80), as shown in FIG. 7(i). Accordingly, the data DTCLSP (04) are the toner supply data relating to the developing material transported to the converging position after 4 seconds, i.e., the developing material at position P1. Furthermore, the data DTCLSP (30) and (56) are toner supply data relating respectively to the developing material transported to the converging position P0 after 30 seconds and 56 seconds, i.e., the developing material at intermediate position P2 and detection position P3.

The aforesaid toner supply data are created in the manner described below. First, when a determination is made that the toner density of the developing material passing the detection position P3 is lower than a predetermined reference density based on the detection results of the toner density sensor 17 at a moment t=0, [1] (indicated by the broken line) is added to the data DTCLSP (04), (30) and (56) stored at addresses M(04), (30), (56), as shown in FIG. 7(i).

Figure 7:
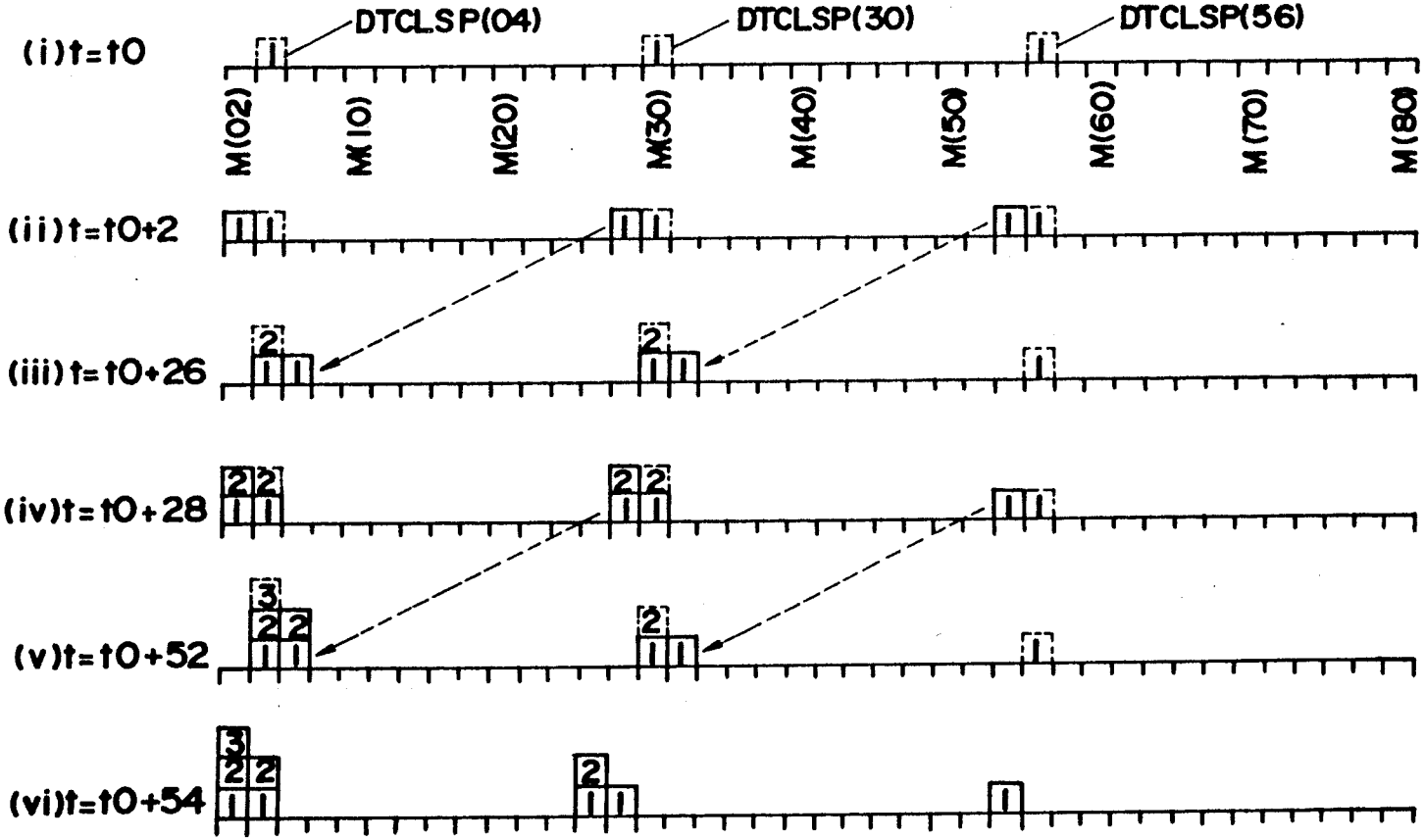
FIG. 7 is an illustration showing the toner supply data.

Two seconds after the aforesaid moment t=0 (moment t=0+2 seconds), the developing material at positions P1, P2 and P3 at the aforesaid moment t=0 has traveled such that said developing material will arrive at the converging position P0 after 2 seconds, 28 seconds and 54 seconds, respectively. Accordingly, at the moment t=0+2 seconds, the data DTCLSP (04), (30) and (56) stored memory addresses M(04), (30) and (56) at the aforesaid moment t=0 are rewritten to addresses M(02), (28) and (54), respectively, as shown in FIG. 7(ii). The value (0) is written to the address M(80).

If the toner density is determined via the toner density sensor 17 to be lower than the reference density at the moment t=t0+2 seconds, [1] (indicated by the broken line) is added to the toner supply data DTCLSP (04), (30) and (56) stored at addresses M(04), (30) and (56), respectively.

Therefore, the toner supply data DTCLSP (04), (30) and (56) stored at addresses M(04), (30) and (56) are respectively rewritten to the next lower addresses every two seconds. If the toner density is lower than the reference density, [1] is added to the respective toner supply data DTCLSP (04), (30) and (56), such that the toner supply data DTCLSP are produced as shown in FIGS. 7(iii) to 7(vi), until said toner supply data DTCLSP are updated to a maximum [3].

Thus, the toner supply data are produced in the previously described manner, and toner is supplied in accordance with said data in the manner described hereinafter. That is, the developing material delivered to the supply position P4 from the toner hopper 21 requires two seconds to arrive at the converging position P0, such that the toner supply data DTCLSP (02) are read for the developing material transported to the converging position P0 after two seconds and are used by the microcomputer MC as the data for determining whether or not the toner supply is necessary. If the data DTCLSP (02) is [0], toner supply is unnecessary. When the data DTCLSP (02) is [1], [2] and [3], the respective toner supply data are activated at times t1, t2 (t2=2·t1) and t3 (t3=3·t1)to deliver toner to the supply position P4. The supplied toner is mixed with the developing material transported to the converging position P0 after two seconds.

The toner supply controls are described in detail hereinafter with reference to the accompanying flow charts.

Figure 8:
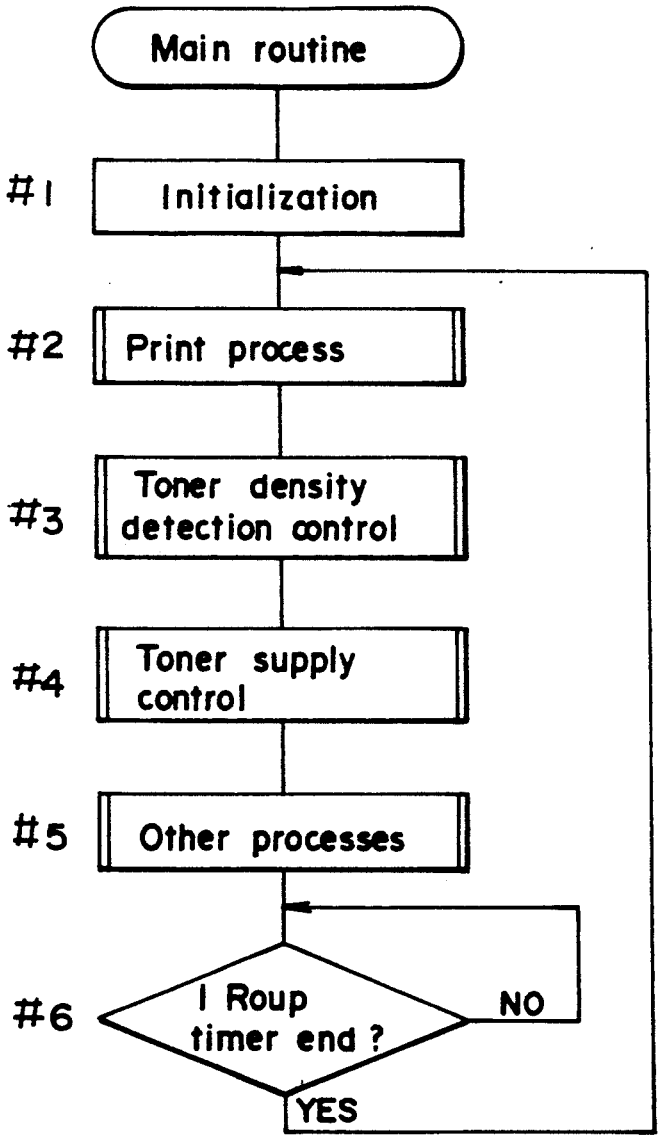
FIG. 8 is a flow chart showing the main control of the copying machine.

When the power supply is turned on for the image forming apparatus having the previously mentioned developing device 1', the microcomputer is initialized (step #1) to set the power on state for the typical copying machine or the like, as shown in FIG. 8.

Next, the print process is executed (step #2) in accordance with the presence of a print signal. Then, the toner density detection control (step #3) and toner supply control (step #4) are executed. Thereafter, other processes (step #5) and the one-loop timer completion determination (step #6) are executed. When the one-loop timer (one-loop loop=10 msec) is completed, the print process (step #2) is again executed.

Figure 9:
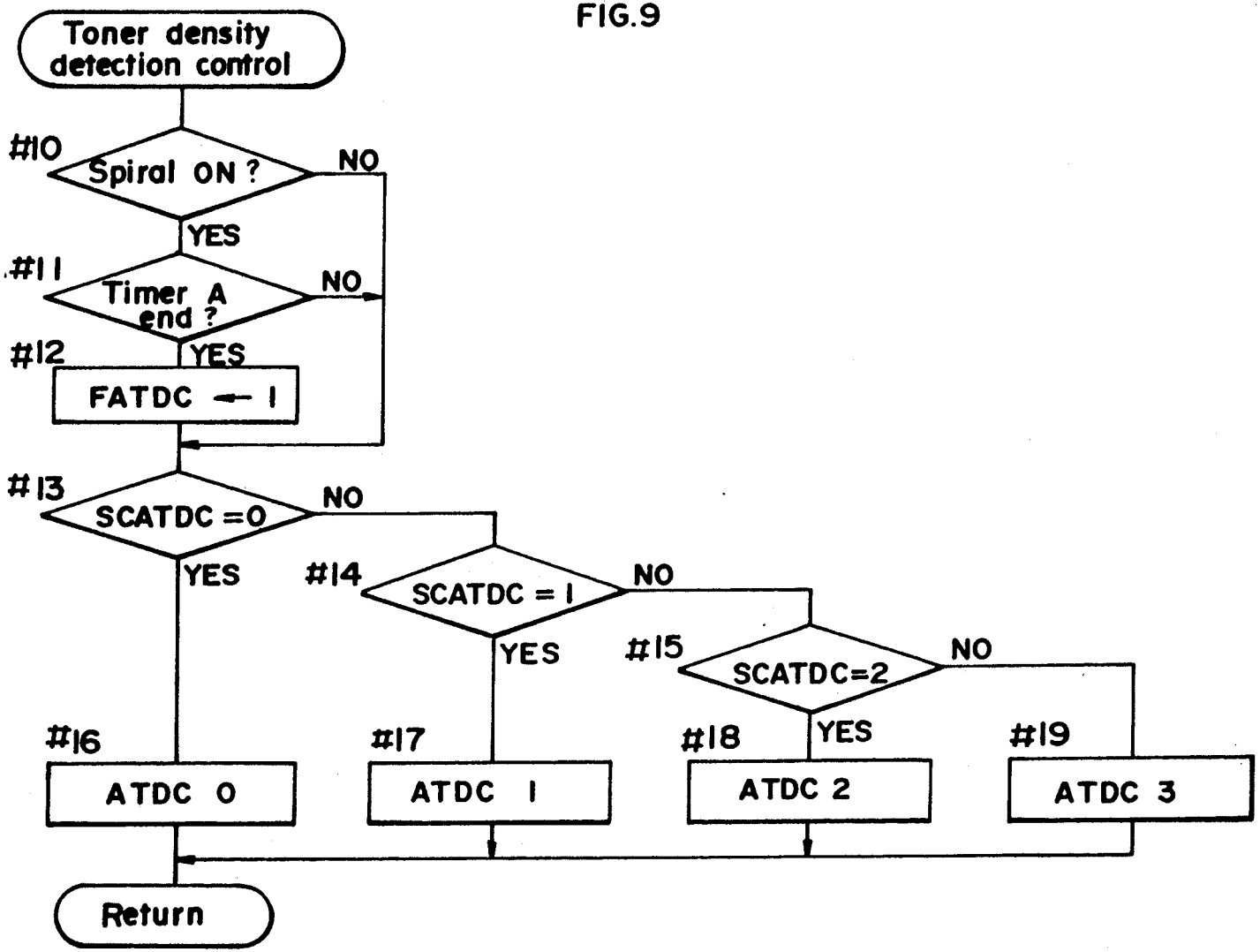
FIG. 9 is a flow chart showing the toner density detection control.

In the aforementioned toner supply control shown in FIG. 9, a determination is made as to whether or not the front and back spirals 14 and 15 are currently operating (step #10), and the end of the timer A (=2 seconds) for setting the timing of detecting toner density is checked. When timer A ends, the density determination start flag FATDC is set at [1] (step #12), and the toner density determination is started via subsequent process. On the other hand, if the timer A has not yet ended, the density determination start flag FATDC is maintained as is.

In steps #13 through #15, the state value of the state counter SCATDC is determined. Then, the program jumps to steps #16 through #19 in accordance with the state counter SCATDC value ([0], [1], [2] and [3]). The state counter SCATDC is set at [0] when power is turned on to the image forming apparatus.

Figure 10:
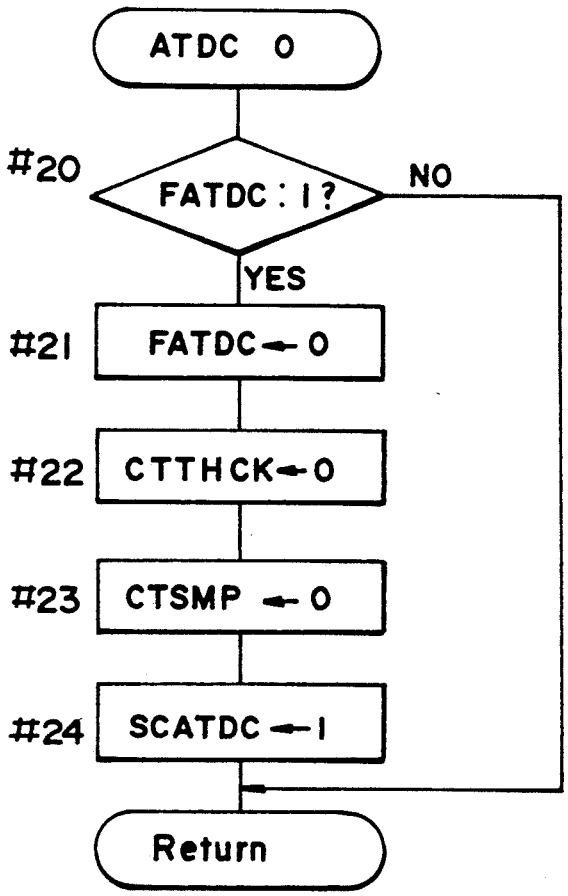
FIG. 10 is a flow chart for ATDC0 in the toner density detection control.

When the state counter SCATDC is [0] in step #13 of FIG. 9, a check is made to determine whether or not the density determination start flag FATDC is set at [1] (step #20), as shown in FIG. 10. If the density determination start flag FATDC is set at [0], the routine returns. On the other hand, if the density determination start flag FATDC is set at [1], said flag is reset at [0] (step #21). Then, the high density counter CTTHCK and the sample counter CTSAMP are respectively reset at [0] (steps #22 and #23), and the state counter SCATDC changed to [1] (step #24). The aforementioned high density counter CTTHCK and sample counter CTSAMP are described later.

Figure 11:
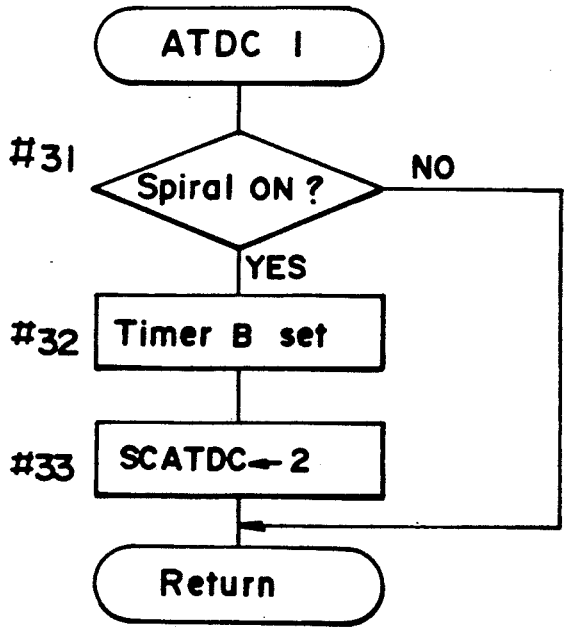
FIG. 11 is a flow chart for ATDC1 in the toner density detection control.

When the state counter SCATDC is set at [1], a check is made to determine whether or not the front and back spirals 14 and 15 are currently rotating (step #31), as shown in FIG. 11. The aforesaid check is made to interrupt the toner density detection while the front and back spirals 14 and 15 are stationary because the developing material is in a non-circulating state when the spirals 14 and 15 are stationary. When the spirals 14 and 15 are stationary, the routine returns. When the spirals 14 and 15 are currently rotating, however, the delay timer B(=100 seconds) is set (step #32), the state counter SCATDC is changed to [2], and the routine returns. The delay timer B is used to stop the toner density detection until the developing material circulation is stabilized after the spirals 14 and 15 start rotating.

Figure 12:
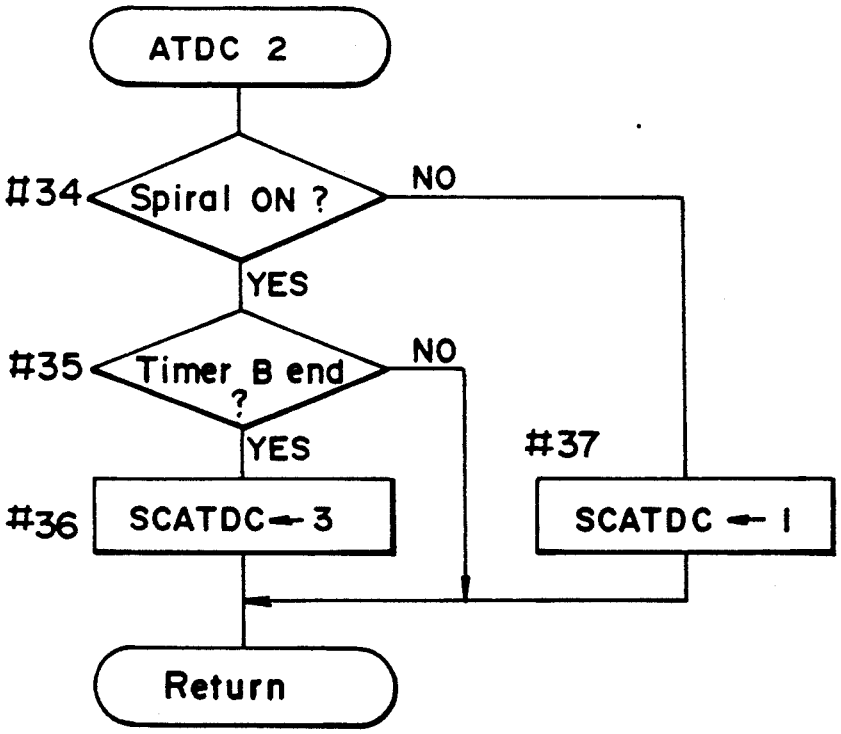
FIG. 12 is a flow chart for ATDC2 in the toner density detection control.

When the state counter SCATDC is set at [2], a check is made to determine whether or not the front and back spirals 14 and 15 are currently rotating (step #34), as shown in FIG. 12. When the spirals 14 and 15 are rotating, a check is made to determine whether or not the delay timer B has ended (step #35). If the delay timer B has ended, the state counter SCATDC is changed to [3]. On the other hand, when the spirals 14 and 15 are stationary, the state counter SCATDC is changed to [1] (step #37).

Figure 13:
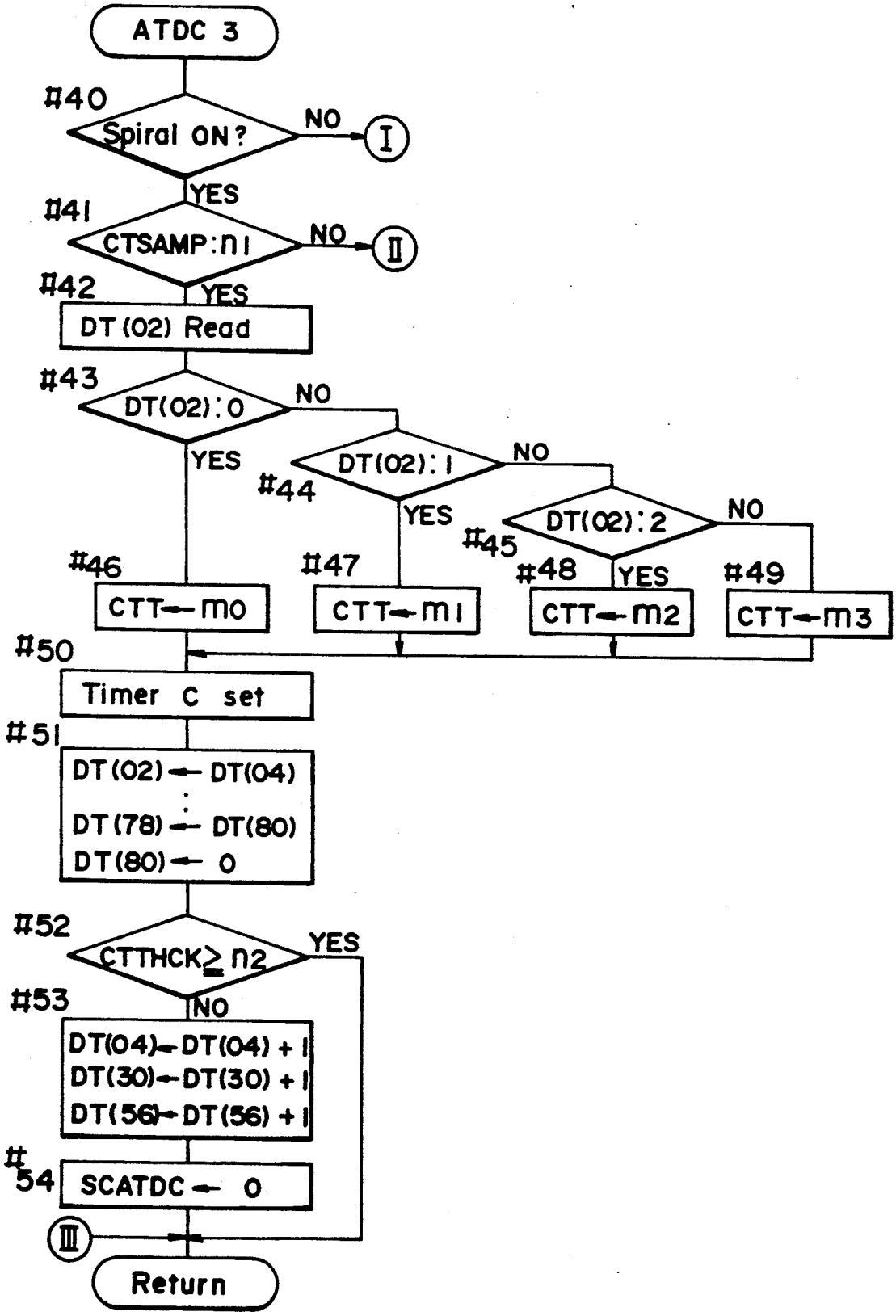
FIG. 13 is a flow chart for ATDC3 in the toner density detection control.
Figure 14:
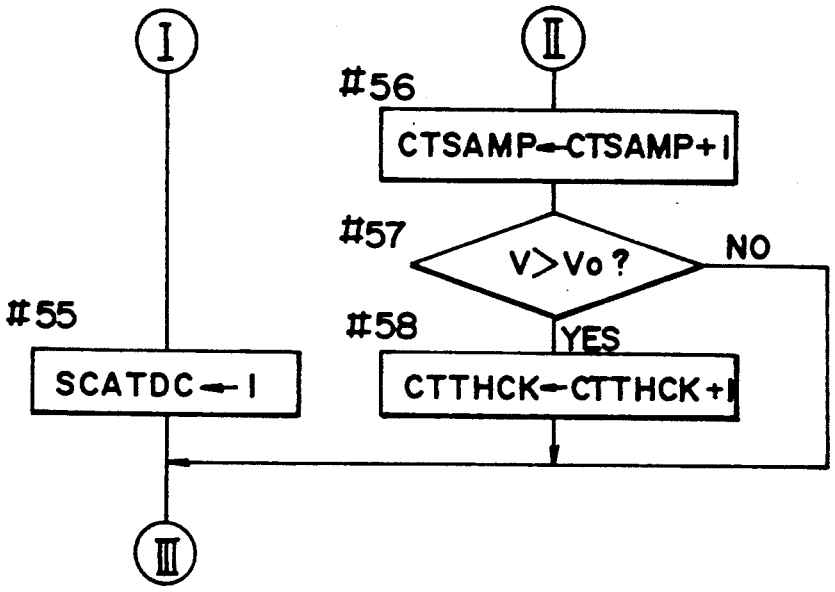
FIG. 14 is a flow chart for ATDC3 in the toner density detection control.

When the state counter SCATDC is set at [3], a check is made to determine whether or not the spirals 14 and 15 are currently rotating (step #40), as shown in FIGS. 13 and 14. If the spirals 14 and 15 are stationary, the state counter SCATDC is changed to [1] (step #55). On the other hand, if the spirals 14 and 15 are currently rotating, a check is made to determine whether or not the sample counter CTSAMP has reached a value n1 (step #41). The sample counter CTSAMP is a counter that counts the signals transmitted from the toner density sensor 17 which are input thereto each time the one-loop counter (=10 ms) ends, and wherein the aforesaid value n1 is set at, for example, a value of [10]. That is, ten individual data from the signals transmitted from the toner density sensor 17 are continuously sampled, and the toner density is determined based on said sampling data.

If the sample counter CTSAMP value has not yet reached the value n1 (=10), the value [1 ]is added to the sample counter CTSAMP (step #56), whereupon the output voltage V of the toner density sensor 17 is compared to a reference voltage V0 corresponding to a predetermined toner density (step #57). The output voltage V of the toner density sensor 17 is directly proportional to the toner density, such that the output voltage of the sensor 17 increases as the toner density increases. When the output voltage V of the toner density sensor 17 exceeds the reference voltage V0, a value [1] is added to the high density counter CTTHCK (step #58). That is, the toner density is determined for the aforementioned ten individual sample data, and the frequency of the determined toner density which exceeds the reference density is recorded in the high density counter CTTHCK.

On the other hand, when the sample counter CTSAMP value reaches n1 (=10), i.e., when the sampling data includes ten individual samples, the previously mentioned toner supply data DTCLSP (02) are read (step #42). For example, if the toner supply data are created as shown in FIG. 7, the DTCLSP (02) data are read.

Then, the value of the read toner supply data DTCLSP (02) are discriminated in steps #43 through #45. The timer counter CTT of the timer C for standardizing the toner supply time in steps #46 through #49 is set at m0 (=0), m1, m2 and m3 when the value of the toner supply data DTCLSP (02) is [0], [1], [2] and [3], respectively. The aforesaid timer counter CTT values m0, m1, m2, and m3 respectively correspond to 0 s (seconds), 0.55 s, 1.10 s, and 1.64 s.

Next, the timer C is set (step #50), and the toner supply data DTCLSP (04), (06), . . . , (80) are rewritten to toner supply data DTCLSP (02), (04), . . . , (78), respectively (step #51), thereby updating the said toner supply data (refer to FIG. 7). The value (0) is written to the toner supply data DTCLSP (80).

Next, a check is made to determine whether or not the aforesaid high density counter CTTHCK exceeds a reference value n2 (for example, a value of [5]) (step #52). If the high density counter CTTHCK value is less than n2 (i.e., is [4] or less), the toner density of the developing material at the detection position P3 is confirmed to be lower than a reference density and, therefore, a value [1] is respectively added to the toner supply data DTCLSP (04), (30 and (56) (step #53) and the state counter SCATDC is changed to [1] (step #54). On the other hand, if the high density counter CTTHCK exceeds the value n2 (i.e., is greater than [5]), the toner density of the developing material at the detection position P3 is confirmed to be greater than the reference density and, therefore, the toner supply data DTCLSP (04), (30) and (56) are not updated.

Figure 15:
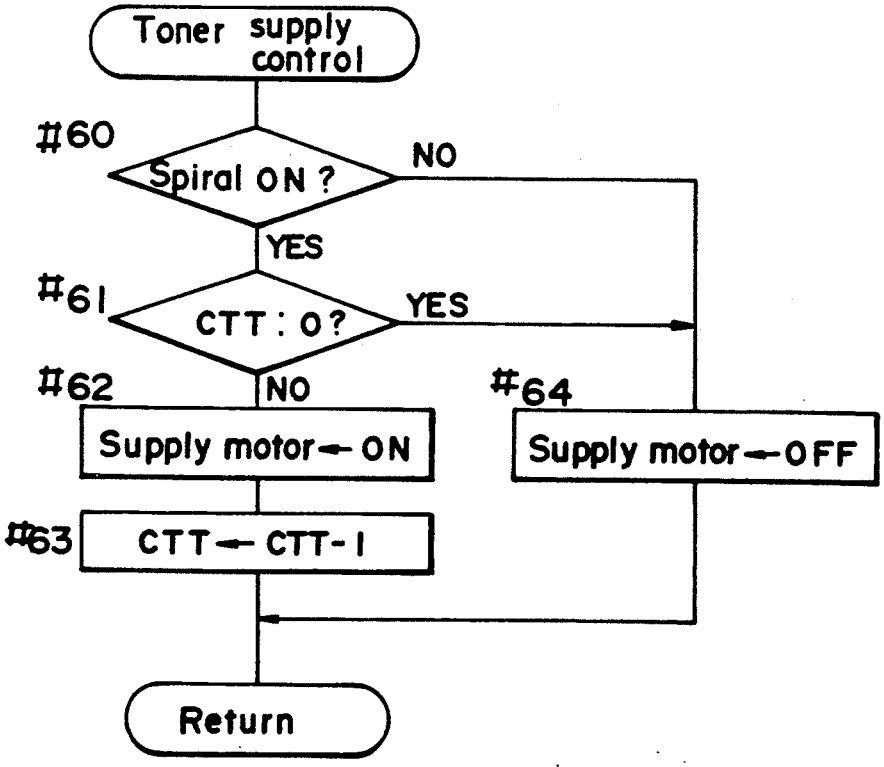
FIG. 15 is a flow chart showing the toner supply control.

In step #4 of the toner supply control, a check is made to determine whether or not the spirals 14 and 15 are currently rotating (step #60), and a check is made to determine whether or not the timer counter CTT value is [0] (step #61), as shown in FIG. 15.

When the spirals 14 and 15 are rotating, i.e., when the timer counter CTT value is not [0], the toner supply motor 25 is actuated so as to deliver toner from the toner hopper 21 to the supply path 11 (step #62), whereupon the timer counter CTT value is decreased by [1] (step #62). When, on the other hand, the spirals 14 and 15 are stationary, or when a predetermined quantity of toner is completed and the timer counter CTT value reaches [0], the toner supply motor is stopped (step #64). That is, the necessity of toner supply and the quantity of toner to be supplied are determined in accordance with the value of the timer counter CTT which is determined by the toner supply data DTCLSP (02). Accordingly, when the toner density is determined to be low at the toner density detection position, said detection position is used as a reference for dividing the developing material circulation path into three parts with additional two locations and toner is supplied to the developing material at the two additional locations and the detection position.

Figure 16:
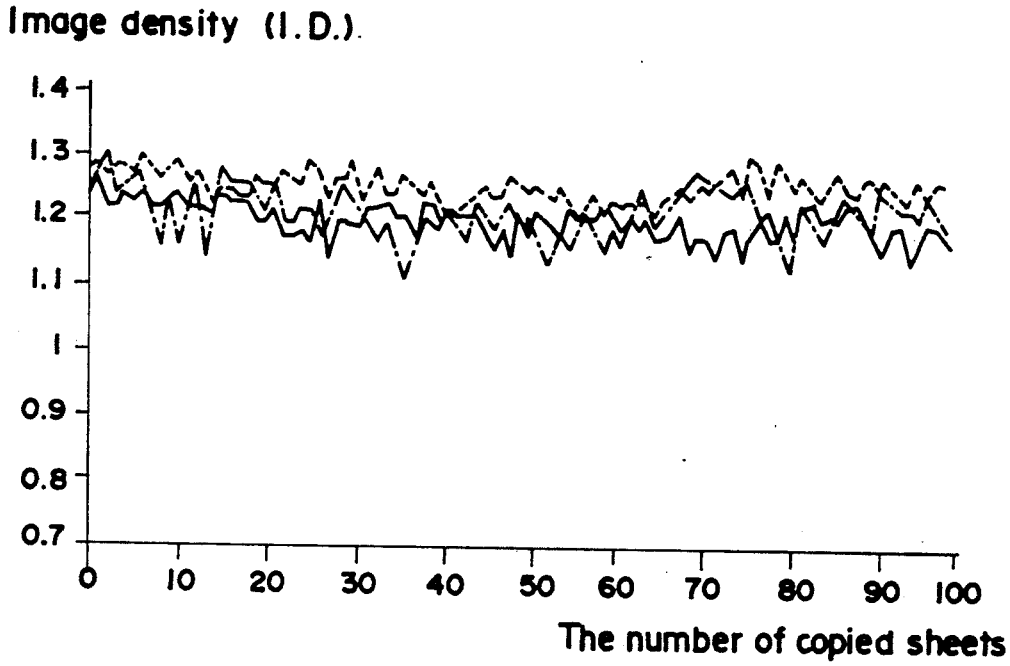
FIG. 16 is an illustration showing the relationship between the number of copied sheets and the image density in a first embodiment of the copying machine of the present invention.

The first embodiment of the copying machine of the present invention using the previously described toner supply method was used to make 100 copies, and the density of the copy images and output voltage of the toner density sensor were measured. FIG. 16 shows the measure image densities, and FIG. 17 shows the measured output voltages of the toner density sensor.

Figure 17:
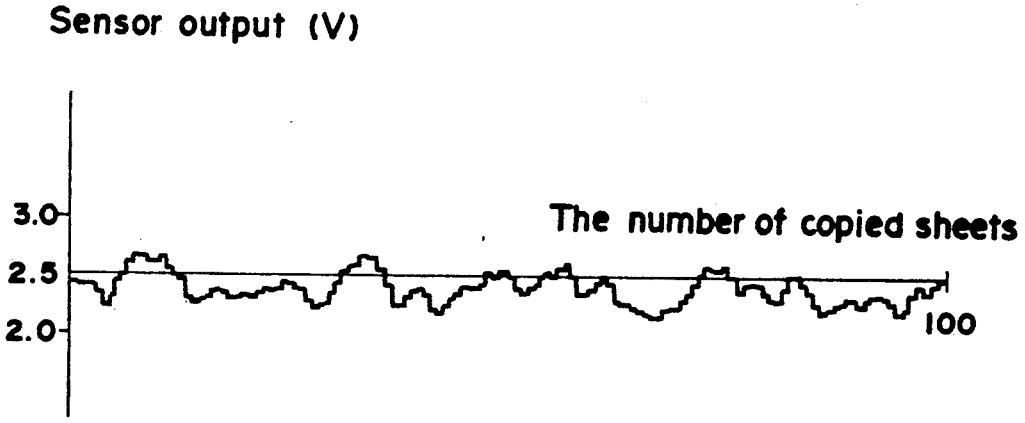
FIG. 17 is an illustration showing the relationship between the number of copied sheets and the image density in a second embodiment of the copying machine of the present invention.

A comparison of the results shown in FIGS. 16 and 17 with the test results of a copying machine using a conventional toner supply method clearly shows that the copying machine of the first embodiment of the invention produced only slight variation in image density, and fluctuation in the output voltage of the toner density sensor was extremely slight. That is, the toner supply method of the present invention stabilizes toner density in the developing material throughout the entire circulation system, thereby stabilizing the copy image density.

In the previously described first embodiment, when the toner density of the developing material at the detection position is determined to be lower than the reference density, the toner supply data DTCLSP (56) for the developing material at the detection position and the toner supply data for the developing material at the positions which divide the circulation system into three parts (using the detection position as reference) are updated. The toner supply data at non-detection positions that may be updated are not limited in the present embodiment. For example, the developing material circulation system may be divided into four parts, and, in addition to the toner supply data DTCLSP (56), the toner supply data DTCLSP (18), (38) and (78) may be updated. Thus, toner is supplied uniformly throughout the entire circulation path by supplying toner at positions which equally divide the developing material circulation path and include the toner density detection region, and the low density region is effectively eliminated by dispersion of the toner centered on the region having low toner density.

Figure 18:
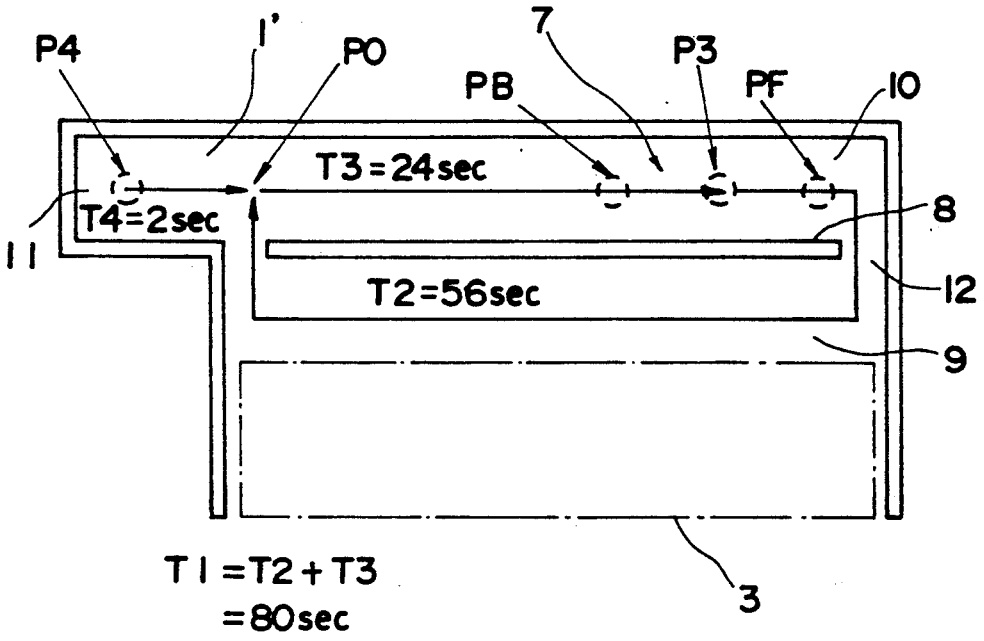
FIG. 18 is a top plan view showing the circulating transport path of the developing material within the developing device provided in a second embodiment of the copying machine of the present invention.

A second embodiment of the copying machine of the present invention is described hereinafter wherein the developing material circulation system need not be integrally divided. As shown in FIG. 18, the toner supply data may be updated for developing material at front and back positions PF and PB of the detection position P3 with respect to the toner transport direction, which are disposed relatively near the detection position P3. In such a case, toner is supplied not only to the developing material in the area determined to have low toner density, but also to the area in the front and back of said low density area. This method allows low density area to be eliminated rapidly by supplying toner in equal portions to the front and back of the area determined to have low toner density, thereby providing even greater stability throughout the entire circulation path.

Moreover, the toner density in the supply area is further stabilized by toner distribution in equal segment at the front and back of the detection position. This method is particularly effective when applied to a long circulation path wherein the distance from the detection position to the end of the circulation path is too long to be readily divided in equal parts.

Stable toner supply in the supply area is achieved by equally dividing the circulation path, as described in the first embodiment, as well as by uniform segments at the front and back of the detection position, as described in the second embodiment.

Although the aforesaid embodiments have been described in terms of a developing device wherein toner is consumed from the developing material that has passed the detection position P3 until said developing material reaches the toner supply position (converging position P0), the present invention is not limited to the aforesaid form inasmuch as said present invention is also applicable to developing devices wherein toner is not consumed from the developing material from the detection position until said developing material reaches the toner supply position. That is, the toner supply method of the present invention is also applicable to various forms of developing devices which have a plurality of developing material transport paths at the back of the developing portion wherein said developing material is mixed while circulating in said transport paths.

Although the aforesaid embodiments of the present invention have been described relative to developing devices having two transport paths, it is to be noted that the present invention may also be applied to developing devices having three or more developing material transport paths.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claim is:

1. An image forming apparatus comprising:

a developing device including a developing means for transporting developing material of a toner and a magnetic carrier to a developing region wherein the developing device confronts a photosensitive member, and a transport means for circularly transporting the developing material from a toner supply portion provided in the developing device to the developing means and from the developing means to the toner supply portion while mixing the developing material;

detecting means provided in the developing device for detecting a toner density of the developing material circulating in said developing device; and supply means for supplying the toner from the toner supply portion to the developing material at a first position in the developing device at which the toner density of the developing material is detected and to the developing material at a second position other than the first position in the developing device when the detected toner density of the developing material is less than a predetermined standard density.

2. An image forming apparatus as claimed in claim 1 wherein said supply means supplies the toner required for raising the toner density to the standard density dividually at the first and second positions when the detected toner density of the developing material is less than the standard density.

3. An image forming apparatus as claimed in claim 1 wherein a transport path along which the developing material is circularly transported is equally divided at the first and second positions.

4. An image forming apparatus comprising:

a developing device wherein a developing material of a toner and a magnetic carrier is circularly transported from a toner supply portion to a developing region formed between the developing device and a photosensitive member while mixing the developing material;

detecting means provided in the developing device for detecting a toner density of the circulating developing material at a specified detection position in said developing device;

supply means for supplying the toner from the toner supply portion to the developing material in the developing device; and control means for controlling the supply means so as to supply the toner to the developing material at said detection position and to the developing material at a minimum of one position other than the detection position based on the detection results by the detecting means.

5. An image forming apparatus as claimed in claim 4 wherein the amount of toner to be supplied is determined based on the detection results by the detecting means, and the control means controls the supply means so as to supply the determined amount of toner dividually into the number of times corresponding to the number of the toner supplied positions.

6. An image forming apparatus as claimed in claim 4 wherein a transport path along which the developing material is circularly transported is equally divided at the toner supplied positions.

7. An image forming apparatus as claimed in claim 4 wherein the control means controls the supply means so as to supply the toner to the developing material at an upstream position and a downstream position of the detection position with respect to a toner transport direction in the developing device.

8. An image forming apparatus as claimed in claim 4 wherein said detecting means detects the toner density of the developing material at a predetermined period passage and toner supply data created based on the detection results by the detecting means are updated at the predetermined period passage.

9. A toner supply method performed in an image forming apparatus comprising a developing device provided so as to confront a photosensitive member, said toner supply method comprising the steps of:

circularly transporting a developing material of a toner and a magnetic carrier from a toner supply portion to a developing region between the developing device and the photoconductive member while mixing the developing material;

detecting the toner density of the developing material at a specified detection position in the developing device by means of detecting means provided in the developing device; and supplying the toner to the developing material at said detection position in the developing device and to the developing material at a minimum of one position other than the detection position in the developing device when the detected toner density of the developing material is less than a predetermined standard density.

10. A method as claimed in claim 9 further comprising the steps of:

determining the amount of toner to be required for raising the toner density to the standard density; and dividing the determined amount of toner into the number of times corresponding to the number of the toner supplied positions.

* * * * *

UNITED STATES PATENT AND TRADEMARK OFFICE

CERTIFICATE OF CORRECTION

PATENT NO. : 5,160,968

DATED : November 3, 1992

INVENTOR(S) : Motohiro YAMADA et al

It is certified that error appears in the above-identified patent and that said Letters Patent is hereby corrected as shown below:

TITLE PAGE:

In Section [75], delete "Motohiro Yamada; Mineo Yamamoto, both of Okazaki" and insert -- Motohiro Yamada, Okazaki; Mineo Yamamoto, Gamagori; --.

Signed and Sealed this

Twenty-eighth Day of September, 1993

*Attest:*

BRUCE LEHMAN

*Attesting Officer*

*Commissioner of Patents and Trademarks*